US011333005B2

(12) United States Patent
Provost et al.

(10) Patent No.: US 11,333,005 B2
(45) Date of Patent: May 17, 2022

(54) ONE-TRIP SCREEN INSTALLATION AND CLEANING SYSTEM

(71) Applicants: Wilfred Provost, Tomball, TX (US); Colin Andrew, Cypress, TX (US); Jesse Gerber, Katy, TX (US)

(72) Inventors: Wilfred Provost, Tomball, TX (US); Colin Andrew, Cypress, TX (US); Jesse Gerber, Katy, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 79 days.

(21) Appl. No.: 16/994,988

(22) Filed: Aug. 17, 2020

(65) Prior Publication Data

US 2022/0049581 A1 Feb. 17, 2022

(51) Int. Cl.

| | |
|---|---|
| ***E21B 37/08*** | (2006.01) |
| ***E21B 43/08*** | (2006.01) |
| ***E21B 34/10*** | (2006.01) |
| ***E21B 41/00*** | (2006.01) |
| ***E21B 43/04*** | (2006.01) |
| *E21B 33/12* | (2006.01) |

(52) U.S. Cl.

CPC ..... *E21B 37/08* (2013.01); *E21B 34/10* (2013.01); *E21B 41/0078* (2013.01); *E21B 43/045* (2013.01); *E21B 43/08* (2013.01); *E21B 33/12* (2013.01)

(58) Field of Classification Search

CPC ..... E21B 37/08; E21B 34/10; E21B 41/0078; E21B 43/045; E21B 43/08; E21B 33/12

See application file for complete search history.

(56) References Cited

U.S. PATENT DOCUMENTS

| | | | | |
|---|---|---|---|---|
| 3,101,784 | A * | 8/1963 | Davidson | E21B 37/08 166/158 |
| 4,037,661 | A * | 7/1977 | Ford | E21B 37/08 166/311 |
| 4,733,723 | A * | 3/1988 | Callegari, Sr. | E21B 34/12 166/278 |
| 5,337,819 | A * | 8/1994 | Tailby | E21B 41/0078 166/222 |
| 5,413,180 | A * | 5/1995 | Ross | E21B 33/126 166/387 |
| 6,832,655 | B2 | 12/2004 | Ravensbergen | |
| 7,017,664 | B2 * | 3/2006 | Walker | E21B 37/06 166/278 |
| 7,331,388 | B2 * | 2/2008 | Vilela | E21B 37/08 166/278 |

(Continued)

*Primary Examiner* — Steven A MacDonald

(74) *Attorney, Agent, or Firm* — Cantor Colburn LLP

(57) ABSTRACT

A one-trip screen installation and cleaning system includes a tubular supporting a screen. The tubular has an inner surface defining a flow bore positioned radially inwardly of the screen. At least one actuator extends radially inwardly from the inner surface and is positioned axially offset relative to the screen. The at least one actuator includes at least one actuator surface. A wash pipe is arranged in the flow bore. The wash pipe includes a bypass valve including a selectively openable outlet port, a spray cleaning device arranged axially outwardly of the selectively openable outlet port, and an inflow control valve arranged between the selectively openable outlet port and the spray cleaning device.

18 Claims, 5 Drawing Sheets

(56) References Cited

U.S. PATENT DOCUMENTS

| | | | | |
|---|---|---|---|---|
| 8,496,055 | B2 * | 7/2013 | Mootoo | E21B 21/10 166/278 |
| 8,770,290 | B2 * | 7/2014 | van Petegem | E21B 34/102 166/278 |
| 9,085,960 | B2 * | 7/2015 | van Petegem | E21B 17/07 |
| 2003/0037925 | A1 * | 2/2003 | Walker | E21B 43/04 166/276 |
| 2006/0231253 | A1 * | 10/2006 | Vilela | E21B 43/25 166/278 |

* cited by examiner

ONE-TRIP SCREEN INSTALLATION AND CLEANING SYSTEM

BACKGROUND

In the resource recovery industry, it is often times necessary to install equipment at a sandface or internal surface of a wellbore. The equipment also benefits from sand control, in the form of screens, that allow formation fluid in but exclude sand and other debris that may impede flow. Often times sand control is supported by a gravel pack in which a slurry is deposited in an annulus between two packers.

Typically, the slurry is run into a tubular as a fluid flow passing into the wellbore, the slurry exits the tubular between the two packers depositing the slurry. The fluid flow passes through a screen assembly, is filtered and run back into the tubular and returned to the surface. After the screen assembly is run in and installed, and the gravel packing operation completed, a clean out operation is initiated. For the clean out, a wash pipe is run into the tubular to a selected depth and positioned at the screen assembly. Once in position, a cleanout operation is initiated.

The need for a separate trip to clean out the screens introduces undesirable delays and costs into an already costly resource extraction operation. Re-entering a lower completion also requires the need to reopen and reclose isolation valves which may not always be possible. Accordingly, in today's competitive environment, the industry would welcome a system that could, in a single trip install a screen system, and perform a gravel packing operation, while performing a self-cleaning operation in a single trip into the wellbore

SUMMARY

Disclosed is a one-trip screen installation and cleaning system including a tubular supporting a screen. The tubular has an inner surface defining a flow bore positioned radially inwardly of the screen. At least one actuator extends radially inwardly from the inner surface and is positioned axially offset relative to the screen. The at least one actuator includes at least one actuator surface. A wash pipe is arranged in the flow bore. The wash pipe includes a bypass valve including a selectively openable outlet port, a spray cleaning device arranged axially outwardly of the selectively openable outlet port, and an inflow control valve arranged between the selectively openable outlet port and the spray cleaning device.

Also disclosed is a resource exploration and recovery system including a surface system and a subsurface system including a one-trip screen installation and cleaning system. The one-trip screen installation and cleaning system includes a tubular supporting a screen. The tubular has an inner surface defining a flow bore positioned radially inwardly of the screen. At least one actuator extends radially inwardly from the inner surface and is positioned axially offset relative to the screen. The at least one actuator includes at least one actuator surface. A wash pipe is arranged in the flow bore. The wash pipe includes a bypass valve including a selectively openable outlet port, a spray cleaning device arranged axially outwardly of the selectively openable outlet port, and an inflow control valve arranged between the selectively openable outlet port and the spray cleaning device.

Further disclosed is a method of installing and washing a screen includes introducing a wash pipe into a tubular string supporting a screen, directing a fluid through an outlet port of a bypass valve at a first pressure, shifting the wash pipe to engage the bypass valve with a closing profile on an actuator, closing the outlet port of the bypass valve with the closing profile, increasing the first pressure to a second pressure that is greater than the first pressure, sensing a decrease in fluid pressure from the second pressure indicating an opening of an inflow control valve, directing the fluid through the inflow control valve to a spray cleaning device, and passing the fluid through the spray cleaning device toward the screen.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
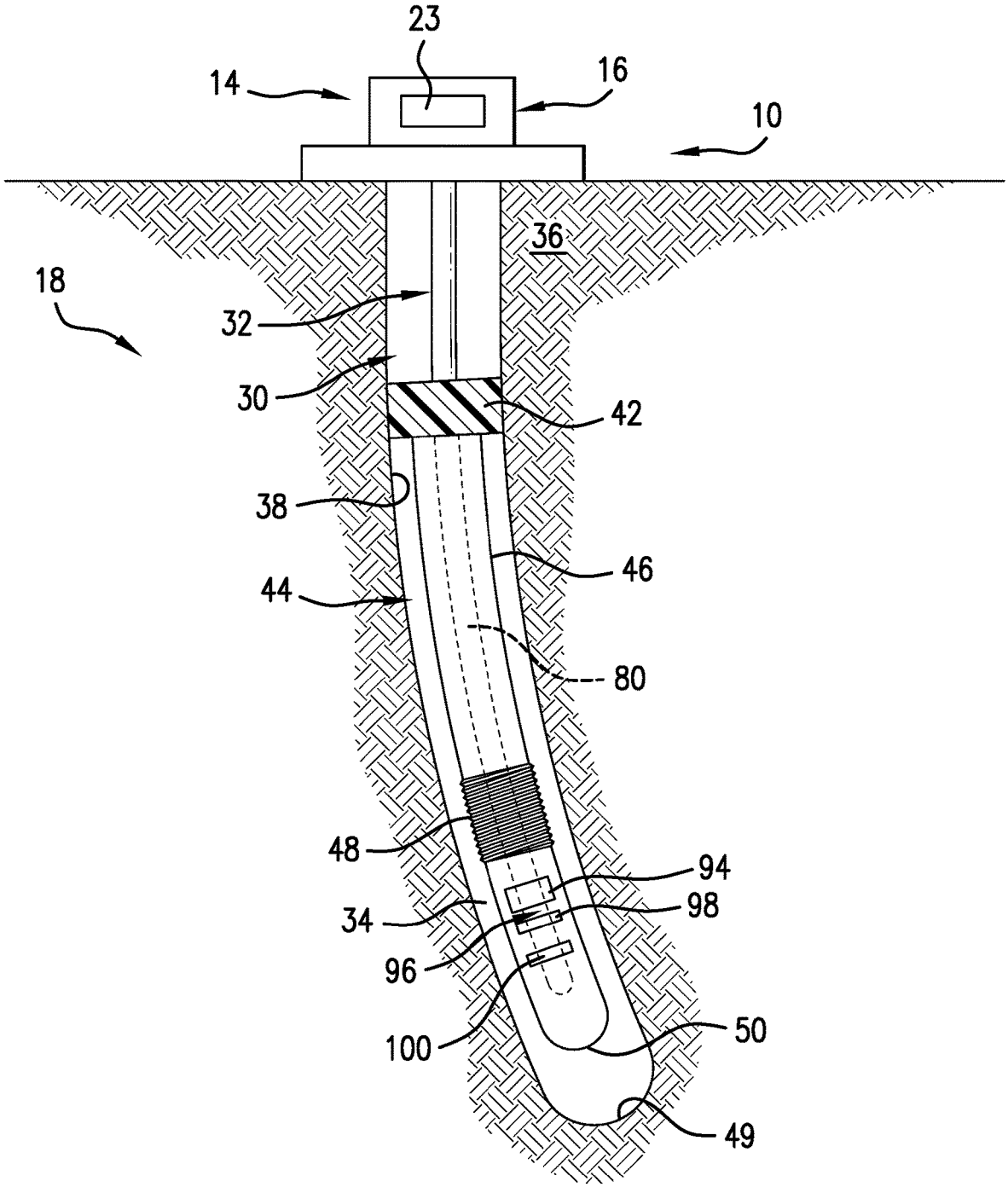
FIG. 1 depicts a resource exploration and recovery system including a one-trip screen installation and cleaning system, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subterranean system. First system 14 may include a control system 23 that may provide power to, monitor, communicate with, and/or activate one or more downhole operations as will be discussed herein. Surface system 16 may include additional systems such as pumps, fluid storage systems, cranes and the like (not shown).

Second system 18 may include a work string 30, formed from one or more tubular members, such as indicated at 32, which extends into a wellbore 34 formed in a formation 36. Wellbore 34 includes an annular wall 38 which may be defined by a surface (not separately labeled) of formation 36.

At least one packer, such as indicated at 42 is provided in wellbore 34. A production zone 44 is defined downhole of packer 42. The number, length and spacing of production zones may vary. A tubular 46 extends from packer 42 downhole. Tubular 46 includes an outer surface 47 that supports a sand screen 48 in production zone 44. Tubular string 30 may extend toward a toe 49 of wellbore 34 and terminate at a shoe 50.

Figure 2:
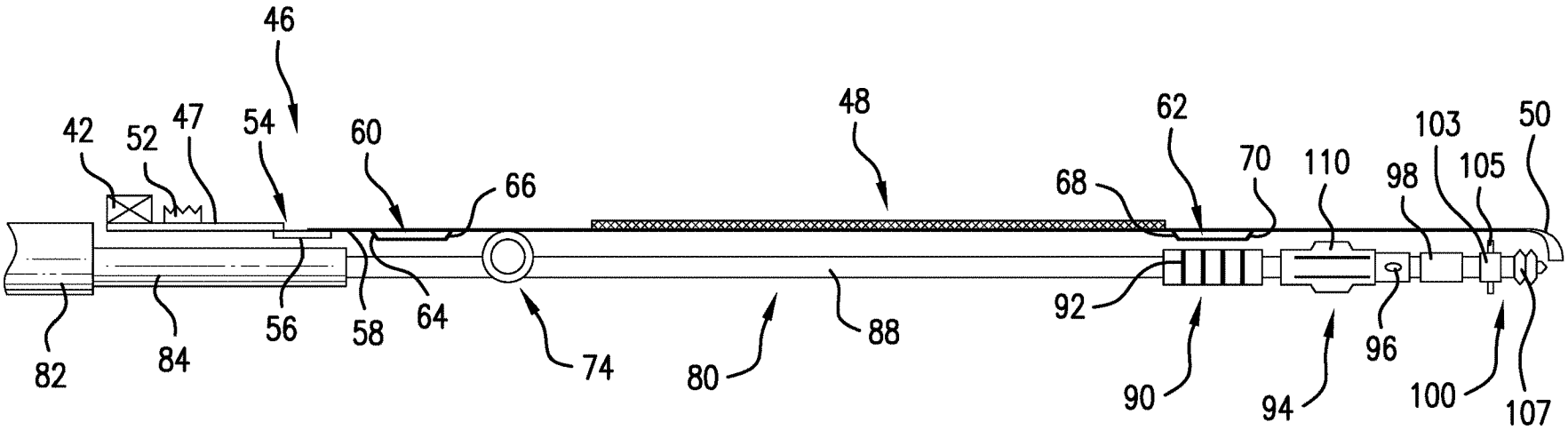
FIG. 2 depicts the one-trip screen installation and cleaning system, in accordance with an aspect of an exemplary embodiment.

Referring to FIG. 2, tubular 46 may also support a slip or anchor 52 positioned downhole of packer 42. Anchor 52 locks tubular 46 to annular wall 38. A slurry transfer port 54 may be arranged downhole of slip 52. A slidable sleeve 56 selectively covers and uncovers slurry transfer port 54. Tubular 46 may further include an inner surface 58 that supports a first actuator 60 arranged uphole of sand screen 48 and a second actuator 62 arranged downhole of screen 48.

First activator 60 includes a first actuation surface, which may take the form of an opening profile 64 and a second actuation surface that may take the form of a closing profile 66. Similarly, second actuator 62 includes a first actuation surface 68 that may take the form of an opening profile and a second actuation surface 70 that may take the form of a closing profile. In an embodiment, first actuator 60 may take the form of a first seal bore and second actuator may take the form of a second seal bore. However, it should be understood that each actuator may take on various forms. In addition, while shown as having multiple actuation surfaces, each actuator may only include a single actuation surface. In addition to actuators 60 and 62, tubular 44 may support an isolation valve, such as a flapper valve shown schematically at 74 arranged uphole of screen 46.

In an embodiment, a wash pipe 80 may be connected to work string 30. Wash pipe 80 may deliver a fluid into tubular 44 during and/or after a screen setting operation and/or a gravel pack operation. Wash pipe 80 is fluidically connected to a setting tool 82 that may be employed to set packer 42 and a crossover tool 84 that returns gravel pack fluids to surface system 16 during a gravel pack operation. Wash pipe 80 includes a tubular element 88 that passes through flapper valve 74. Tubular element 88 supports a seal member 90 having one or more annular seals 92. A bypass valve 94 is positioned downhole of seal member 90. Bypass valve 94 includes a selectively openable outlet port 96.

In an embodiment, wash pipe 80 also supports an inflow control valve (ICV) 98 arranged downhole of bypass valve 94. ICV 98 is normally closed but may be biased to an open position when exposed to a selected fluid pressure to allow fluid to flow to, for example, a spray cleaning device 100 that is arranged downstream. Spray cleaning device 100 may take the form of a rotating and/or pulsating spray nozzle 103 that, when exposed to a fluid flow, rotates and directs jets of fluid radially outwardly through outlet elements 105. In an exemplary aspect, a shifting tool 107 may be mounted to wash pipe 80 downhole of spray cleaning device 100.

Figure 3A:
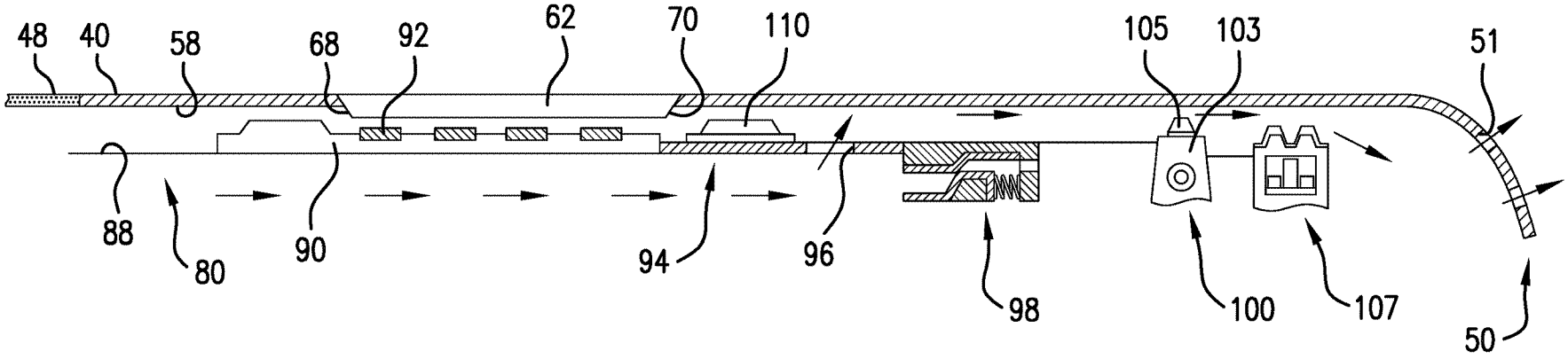
FIG. 3*a* depicts a portion of the one-trip screen installation and cleaning system of FIG. 2 in a first configuration, in accordance with an exemplary embodiment.
Figure 3B:
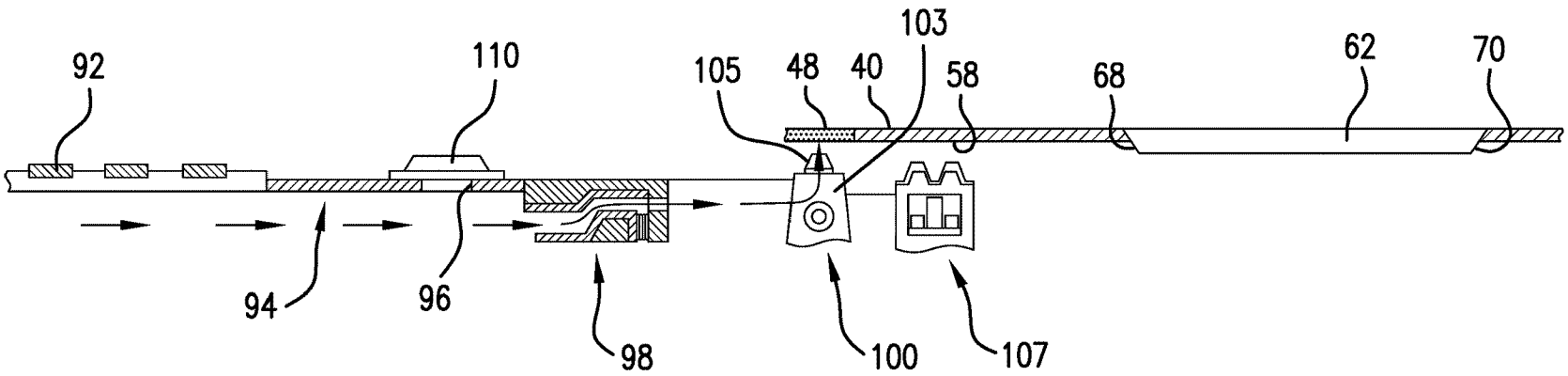
FIG. 3*b* depicts a portion of the one-trip screen installation and cleaning system of FIG. 2 in a second configuration, in accordance with an exemplary embodiment.
Figure 4:
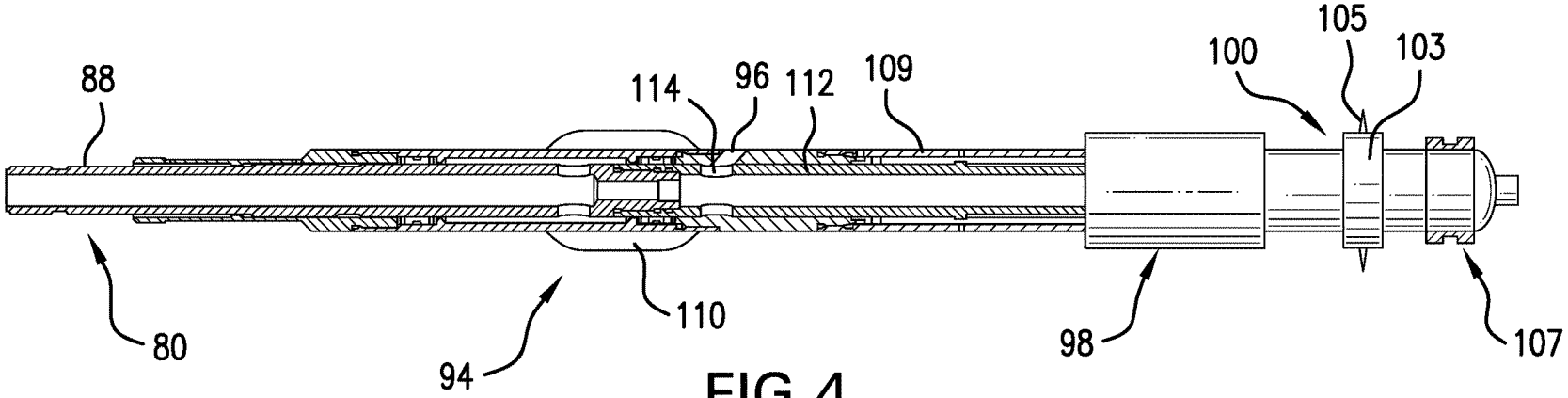
FIG. 4 depicts a portion of the one-trip screen installation and cleaning system of FIG. 2 showing a bypass valve in an open configuration, in accordance with an exemplary embodiment.
Figure 5:
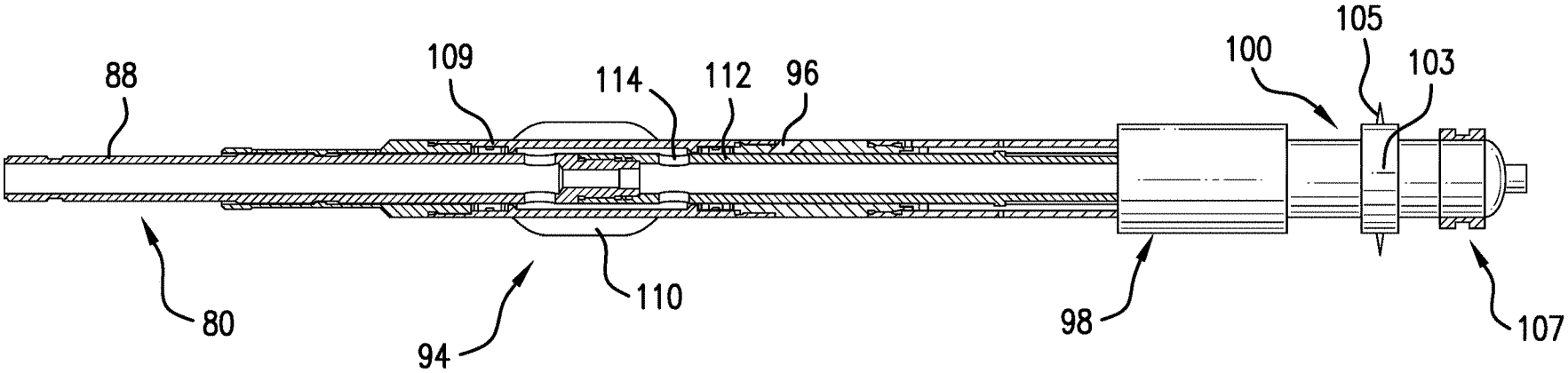
FIG. 5 depicts the portion of the one-trip screen installation and cleaning system of FIG. 4 showing the bypass valve in a closed configuration, in accordance with an aspect of an exemplary embodiment.

Referring to FIGS. 3-5 and with continued reference to FIG. 2, bypass valve 94 includes an outer shell 109 having an increased diameter portion 110. Outer shell 109 is selectively shiftable relative to a central conduit 112 having a passage 112 that may be selectively aligned with outlet port 96. For example, bypass valve 94 may be shifted in a downhole direction past second actuator 62 such that increased diameter portion 110 contacts opening profile 68 sliding outer shell 109 relative to central conduit 112 bringing passage 112 into alignment with outlet port 96 as shown in FIG. 3*a*. Seal member 90 may then seal against second actuator 62 thereby isolating a lower portion of tubular string 32. When open, fluid may pass through outlet port 96 at a first selected pressure and flow toward shoe 50 and from outlets 51 into wellbore 34 such as shown in FIG. 3A.

After the sand screen is set, gravel packing complete, and a flushing of tubular 32 is performed, a screen cleaning operation may commence. Prior to initializing the screen cleaning operation, wash pipe 80 is shifted uphole such that increased diameter portion 110 of bypass valve 94 engages with closing profile 70 on second actuator 62 thereby closing outlet port 96. Wash pipe 80 is moved further uphole to align spray cleaning device 100 with sand screen 46. Once spray cleaning device 100 is in position a sand screen cleaning operation may commence such as shown in FIG. 3*b*.

Figure 6:
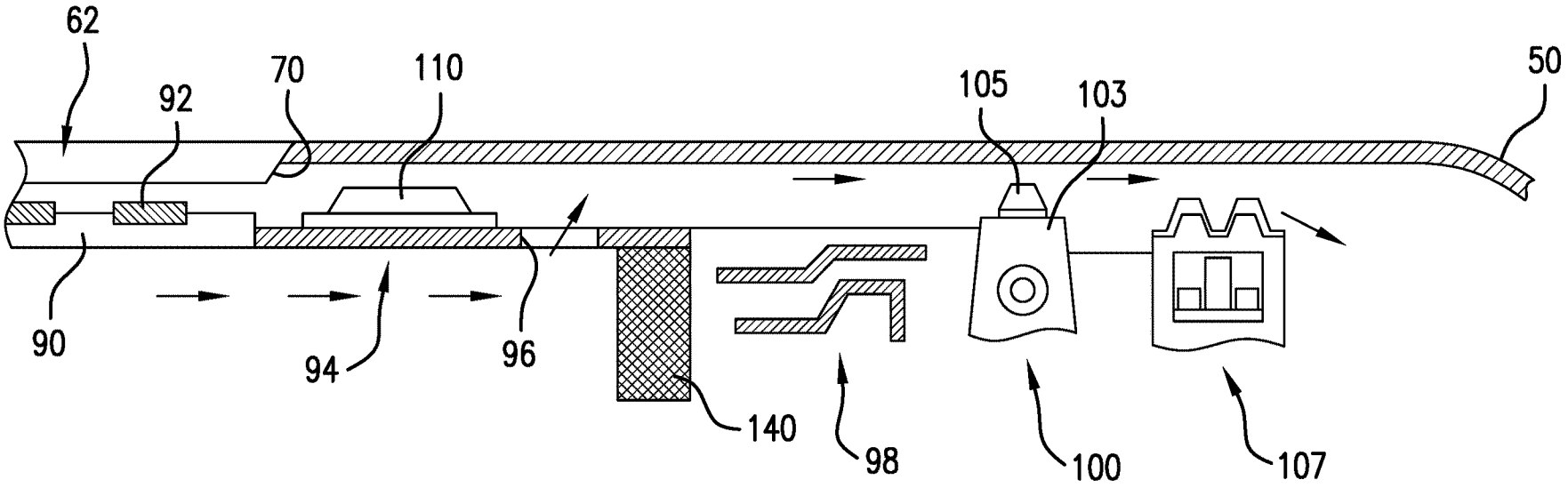
FIG. 6 depicts a portion of a one-trip screen installation and cleaning system, in accordance with another aspect of an exemplary embodiment.

In a sand screen cleaning operation, fluid is introduced into tubular element 88 and pressure increased above that of the first selected pressure. The pressure is increased to a second selected pressure that causes ICV 98 to transition from a closed configuration to an open configuration allowing fluid to flow into and through spray cleaning device 100 onto sand screen 48. During the transition pressure will drop indicating to operators that ICV 98 opened and the cleaning has commenced. Work string 30 may then be shifted, in an uphole direction, a selected length to clean portions of sand screen 48. In an embodiment, the fluid passing to rotating and/or pulsating spray cleaning device 100 may first pass through a filter 140 arranged downhole of outlet port 96 as shown in FIG. 6.

After traveling the selected length, it may be desirable to, for example, remove one or more tubular members 32 from work string 30. The removal of the selection allows work string 30 to be further shifted, in the uphole direction to clean additional portions of sand screen 48. Prior to removal of the section of work string 30, fluid pressure is reduced to below the second selected pressure allowing ICV 98 to close. After the section of work string 30 is removed, pressure may be increased to above the second selected pressure to re-open ICV 98 and continue cleaning sand screen 48.

This process continues until sand screen 48 is cleaned. The process may also continue in a downhole direction if additional cleaning is needed. Regardless of the direction, the incorporation of ICV 98 allows operators to remove and/or add sections of work string 30 without losing the column of fluid in wash pipe 80 and work string 30. Maintaining the column of fluid reduces the time needed to pressure up to continue cleaning and also protects wellbore 34 from a sudden increase of released fluid. Once cleaning is complete, bypass valve 94 may be reopened to allow the column of fluid to slowly drain through outlet port 96 to facilitate withdrawal of wash pipe 80 from wellbore 34 to initiate production of formation fluids or another gravel pack operation further uphole.

Set forth below are some embodiments of the foregoing disclosure.

Embodiment 1. A one-trip screen installation and cleaning system comprising: a tubular supporting a screen, the tubular having an inner surface defining a flow bore positioned radially inwardly of the screen; at least one actuator extending radially inwardly from the inner surface and positioned axially offset relative to the screen, the at least one actuator including at least one actuator surface; and a wash pipe arranged in the flow bore, the wash pipe including a bypass valve including a selectively openable outlet port, a spray cleaning device arranged axially outwardly of the selectively openable outlet port, and an inflow control valve arranged between the selectively openable outlet port and the spray cleaning device.

Embodiment 2. The one-trip screen installation and cleaning system according to any prior embodiment, wherein the at least one actuator includes a first actuator including a first actuation surface and a second actuation surface arranged uphole of the screen and a second actuator including a first actuation surface and a second actuation surface downhole of the screen, the first actuation surface of the first actuator comprising a first opening profile and the second actuation surface of the first actuator comprising a first closing profile, and the first actuation surface of the second actuator comprising a second opening profile and the second actuation surface of the second actuator comprising a second closing profile.

Embodiment 3. The one-trip screen installation and cleaning system according to any prior embodiment, wherein the wash pipe includes a shifting tool arranged on a terminal end thereof.

Embodiment 4. The one-trip screen installation and cleaning system according to any prior embodiment, wherein the tubular includes an outer surface and a selectively expandable packer mounted to the outer surface.

Embodiment 5. The one-trip screen installation and cleaning system according to any prior embodiment, wherein the tubular includes a gravel pack port arranged uphole of the screen.

Embodiment 6. The one-trip screen installation and cleaning system according to any prior embodiment, wherein the spray cleaning device is a revolving pulsating spray nozzle.

Embodiment 7. The one-trip screen installation and cleaning system according to any prior embodiment, further comprising: a setting tool and a cross-over valve connected to the wash pipe.

Embodiment 8. A resource exploration and recovery system comprising: a surface system; and a subsurface system including a one-trip screen installation and cleaning system comprising: a tubular supporting a screen, the tubular having an inner surface defining a flow bore positioned radially inwardly of the screen; at least one actuator extending radially inwardly from the inner surface and positioned axially offset relative to the screen, the at least one actuator including at least one actuation surface; and a wash pipe arranged in the flow bore, the wash pipe including a bypass valve including a selectively openable outlet port, a spray cleaning device arranged axially outwardly of the selectively openable outlet port, and an inflow control valve arranged between the selectively openable outlet port and the spray cleaning device.

Embodiment 9. The resource exploration and recovery system according to any prior embodiment, wherein the at least one actuator includes a first actuator including a first actuation surface and a second actuation surface arranged uphole of the screen and a second actuator including a first actuation surface and a second actuation surface downhole of the screen, the first actuation surface of the first actuator comprising a first opening profile and the second actuation surface of the first actuator comprising a first closing profile, and the first actuation surface of the second actuator comprising a second opening profile and the second actuation surface of the second actuator comprising a second closing profile.

Embodiment 10. The resource exploration and recovery system according to any prior embodiment, wherein the wash pipe includes a shifting tool arranged on a terminal end thereof.

Embodiment 11. The resource exploration and recovery system according to any prior embodiment, wherein the tubular includes an outer surface and a selectively expandable packer mounted to the outer surface.

Embodiment 12. The resource exploration and recovery system according to any prior embodiment, wherein the tubular includes a gravel pack port arranged uphole of the screen.

Embodiment 13. The resource exploration and recovery system according to any prior embodiment, wherein the spray cleaning device is a roto jet cleaning tool.

Embodiment 14. The resource exploration and recovery system according to any prior embodiment, further comprising: a setting tool and a cross-over valve connected to the wash pipe.

Embodiment 15. A method of installing and washing a screen comprising: introducing a wash pipe into a tubular string supporting a screen; directing a fluid through an outlet port of a bypass valve at a first pressure; shifting the wash pipe to engage the bypass valve with a closing profile on an actuator; closing the outlet port of the bypass valve with the closing profile; increasing the first pressure to a second pressure that is greater than the first pressure; sensing a decrease in fluid pressure from the second pressure indicating an opening of an inflow control valve; directing the fluid through the inflow control valve to a spray cleaning device; and passing the fluid through the spray cleaning device toward the screen.

Embodiment 16. The method according to any prior embodiment, further comprising: repositioning the spray cleaning device relative to the screen; and disconnecting a tubular from the tubular string without draining the fluid.

Embodiment 17. The method according to any prior embodiment, further comprising: shifting the wash pipe to engage the bypass valve with an opening profile on another actuator.

Embodiment 18. The method according to any prior embodiment, opening the outlet port of the bypass valve with the opening profile.

Embodiment 19. The method according to any prior embodiment, further comprising: draining the fluid from the outlet port.

Embodiment 20. The method according to any prior embodiment, further comprising: withdrawing the wash pipe from the tubular.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A one-trip screen installation and cleaning system comprising:

a tubular supporting a screen, the tubular having an inner surface defining a flow bore positioned radially inwardly of the screen;

at least one actuator extending radially inwardly from the inner surface and positioned axially offset relative to the screen, the at least one actuator including at least one actuator surface; and a wash pipe having a terminal end arranged in the flow bore, the wash pipe including a bypass valve including a selectively openable outlet port, a spray cleaning device arranged axially outwardly of the selectively openable outlet port, an inflow control valve arranged between the selectively openable outlet port and the spray cleaning device, and a shifting tool arranged at the terminal end.

2. The one-trip screen installation and cleaning system according to claim 1, wherein the at least one actuator includes a first actuator including a first actuation surface and a second actuation surface arranged uphole of the screen and a second actuator including a first actuation surface and a second actuation surface downhole of the screen, the first actuation surface of the first actuator comprising a first opening profile and the second actuation surface of the first actuator comprising a first closing profile, and the first actuation surface of the second actuator comprising a second opening profile and the second actuation surface of the second actuator comprising a second closing profile.

3. The one-trip screen installation and cleaning system according to claim 1, wherein the tubular includes an outer surface and a selectively expandable packer mounted to the outer surface.

4. The one-trip screen installation and cleaning system according to claim 3, wherein the tubular includes a gravel pack port arranged uphole of the screen.

5. The one-trip screen installation and cleaning system according to claim 1, wherein the spray cleaning device is a revolving pulsating spray nozzle.

6. The one-trip screen installation and cleaning system according to claim 1, further comprising: a setting tool and a cross-over valve connected to the wash pipe.

7. A resource exploration and recovery system comprising:

a surface system; and a subsurface system including a one-trip screen installation and cleaning system comprising:

a tubular supporting a screen, the tubular having an inner surface defining a flow bore positioned radially inwardly of the screen;

at least one actuator extending radially inwardly from the inner surface and positioned axially offset relative to the screen, the at least one actuator including at least one actuation surface; and a wash pipe having a terminal end arranged in the flow bore, the wash pipe including a bypass valve including a selectively openable outlet port, a spray cleaning device arranged axially outwardly of the selectively openable outlet port, an inflow control valve arranged between the selectively openable outlet port and the spray cleaning device, and a shifting tool arranged at the terminal end.

8. The resource exploration and recovery system according to claim 7, wherein the at least one actuator includes a first actuator including a first actuation surface and a second actuation surface arranged uphole of the screen and a second actuator including a first actuation surface and a second actuation surface downhole of the screen, the first actuation surface of the first actuator comprising a first opening profile and the second actuation surface of the first actuator comprising a first closing profile, and the first actuation surface of the second actuator comprising a second opening profile and the second actuation surface of the second actuator comprising a second closing profile.

9. The resource exploration and recovery system according to claim 7, wherein the tubular includes an outer surface and a selectively expandable packer mounted to the outer surface.

10. The resource exploration and recovery system according to claim 9, wherein the tubular includes a gravel pack port arranged uphole of the screen.

11. The resource exploration and recovery system according to claim 7, wherein the spray cleaning device is a roto jet cleaning tool.

12. The resource exploration and recovery system according to claim 7, further comprising: a setting tool and a cross-over valve connected to the wash pipe.

13. A method of installing and washing a screen comprising:

introducing a wash pipe into a tubular string supporting a screen;

directing a fluid through an outlet port of a bypass valve at a first pressure;

shifting the wash pipe to engage the bypass valve with a closing profile on an actuator;

closing the outlet port of the bypass valve with the closing profile;

increasing the first pressure to a second pressure that is greater than the first pressure;

sensing a decrease in fluid pressure from the second pressure indicating an opening of an inflow control valve;

directing the fluid through the inflow control valve to a spray cleaning device; and passing the fluid through the spray cleaning device toward the screen.

14. The method of claim 13, further comprising:

repositioning the spray cleaning device relative to the screen; and disconnecting a tubular from the tubular string without draining the fluid.

15. The method of claim 13, further comprising: shifting the wash pipe to engage the bypass valve with an opening profile on another actuator.

16. The method of claim 15, further comprising: opening the outlet port of the bypass valve with the opening profile.

17. The method of claim 16, further comprising: draining the fluid from the outlet port.

18. The method of claim 17, further comprising: withdrawing the wash pipe from the tubular.

* * * * *